US006397003B1

(12) United States Patent
Cheng

(10) Patent No.: US 6,397,003 B1
(45) Date of Patent: May 28, 2002

(54) HOT AIR-BLOWER OFF-STATE RESIDUAL HEAT PREVENTIVE CONTROL CIRCUIT

(76) Inventor: Chuan-Hsin Cheng, 5F, No,637-1, Sec.5, Chung-Hsin Road, San-Chung City, Taipei Hsien (TW)

( * ) Notice: Subject to any disclaimer, the term of this patent is extended or adjusted under 35 U.S.C. 154(b) by 0 days.

(21) Appl. No.: 09/551,294

(22) Filed: Apr. 18, 2000

(30) Foreign Application Priority Data

Apr. 22, 1999 (TW) ..... 88206241 U

(51) Int. Cl.[7] ..... F24H 3/00
(52) U.S. Cl. ..... 392/385; 219/508; 219/480
(58) Field of Search ..... 392/384, 385, 392/379, 360–369; 219/508, 480, 484; 34/96, 97

(56) References Cited

U.S. PATENT DOCUMENTS 1,574,343 A * 2/1926 Frederics ..... 392/380
1,607,195 A * 11/1926 Gross ..... 392/384
1,714,167 A * 5/1929 Hardin ..... 392/365
2,061,258 A * 11/1936 Soverhill ..... 392/365
2,647,198 A * 7/1953 Lautner ..... 392/365
3,131,281 A * 4/1964 Jepson ..... 34/96
4,912,300 A * 3/1990 Hennuy et al. ..... 392/365
5,825,974 A * 10/1998 Hutton et al. ..... 392/360
6,035,097 A * 3/2000 Behrendt et al. ..... 392/380

FOREIGN PATENT DOCUMENTS

GB 2150771 * 7/1985

* cited by examiner

*Primary Examiner*—John A. Jeffery
(74) *Attorney, Agent, or Firm*—Pro-Techtor International Services

(57) ABSTRACT

A hot air-blower off-state residual heat preventive control circuit comprises a power voltage stabilizer circuit, a power frequency detection circuit, a microprocessor, a switching control circuit, a LED display circuit, an amplifier circuit, and a rectifier and noise control circuit, wherein when the user turns on the hot air-blower, the microprocessor drives a first bi-directional switch and a second bi-directional switch to turn on a main thermal resistor and a fan motor respectively; when the user turns off the hot air-blower, the microprocessor drives the first bi-directional switch to turn off the main thermal resistor and keeps the second bi-directional switch turning on the fan motor for a predetermined length of time, and then drives the second bi-directional switch to turn off the fan motor a predetermined length of time after off-state of the main thermal resistor.

3 Claims, 3 Drawing Sheets

HOT AIR-BLOWER OFF-STATE RESIDUAL HEAT PREVENTIVE CONTROL CIRCUIT

BACKGROUND OF THE INVENTION

The present invention relates to a hot air-blower, and more particularly to an off-state residual heat preventive control circuit for a hot air-blower, which keeps the fan motor operating for a certain length of time after turning off the main thermal resistor, enabling the temperature of the hot air-blower to be quickly lowered.

An industrial hot air-blower A, as shown in FIG. 1, is generally comprised of a high impedance thermal resistor B, and a fan motor C. When operated, the thermal resistor B produces heat as high as about 500~600° C., and the fan motor C blows currents of air through the thermal resistor B toward the output port of the hot air-blower A. Because the hot air-blower A is hot during its operation, it must be carefully used. When turning off the hot air-blower A, electricity is cut from the thermal resistor B and the fan motor C, however the hot air-blower A is still very hot at this moment. One may be scalded severely when touching the surface of the hot air-blower A carelessly with the hand or a part of the body a short period of time after the hot air-blower A has been switched off. Because the industrial hot air-blower is normally left in place after an operation, it tends to be forced to fall down by an external object. If the industrial hot air-blower A falls from the standing position, its high temperature may burn or melt the surrounding objects. Furthermore, because the temperature of the hot air-blower A is not quickly reduced after each use, the winding of the fan motor and the related electronic component parts tend to be damaged by heat.

SUMMARY OF THE INVENTION

The present invention has been accomplished to provide a hot air-blower off-state residual heat preventive control circuit, which eliminates the aforesaid problems. It is therefore the main object of the present invention to provide a hot air-blower off-state residual heat preventive control circuit, which enables the temperature of the hot air-blower to be quickly reduced to the safety range after each use. It is another object of the present invention to provide a hot air-blower off-state residual heat preventive control circuit, which prolongs the service life of the hot air-blower. According to the present invention, a microprocessor is controlled by a power frequency detection circuit to keep the fan motor operating for a predetermined length of time after power supply has been cut off from the main thermal resistor, enabling the temperature of the hot air-blower to be quickly reduced to the safety range within a short time.

DETAILED DESCRIPTION OF THE PREFERRED EMBODIMENT

Figure 1:
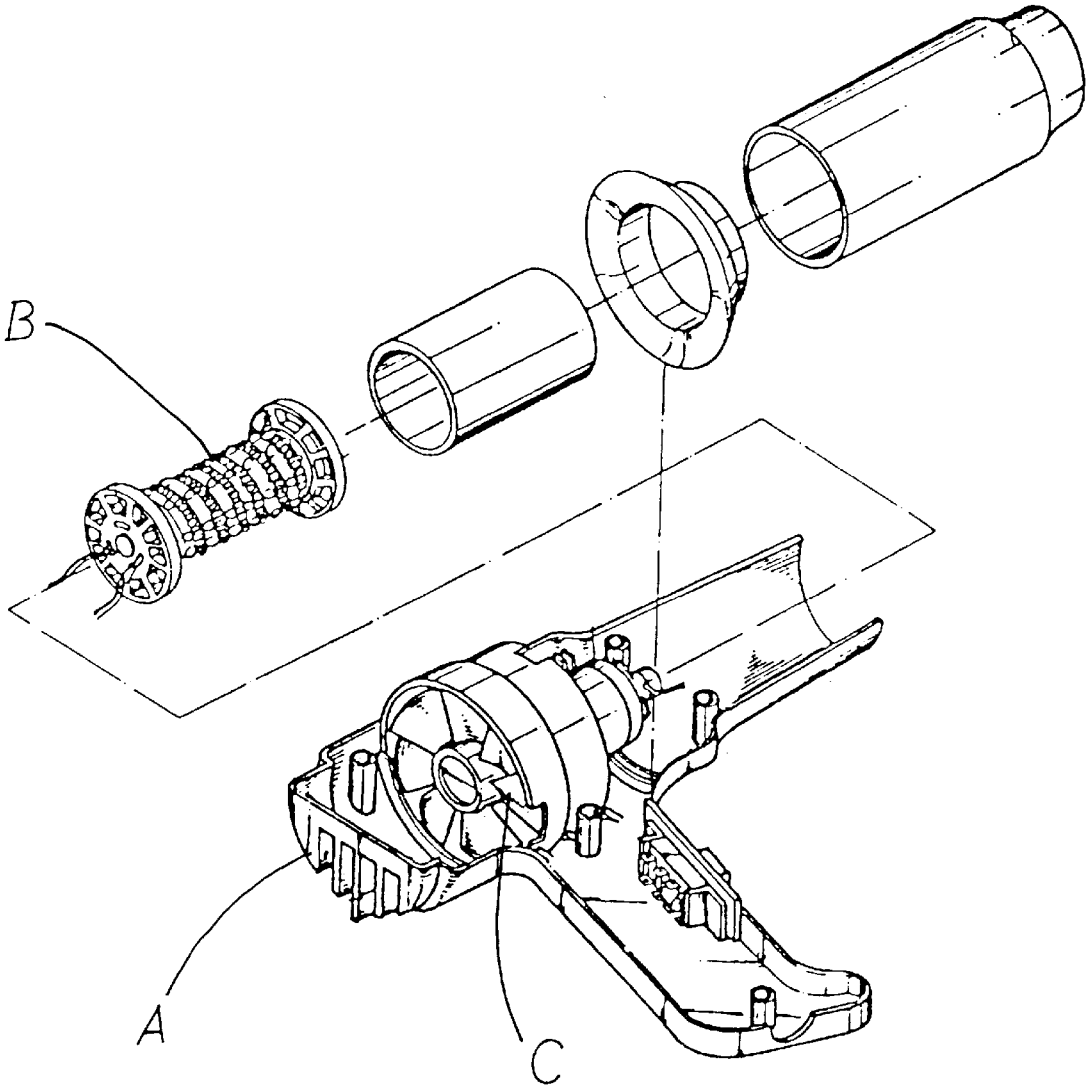
PRIOR ART FIG. 1
FIG. 1 is an exploded view of a hot air-blower according to the prior art.
Figure 2:
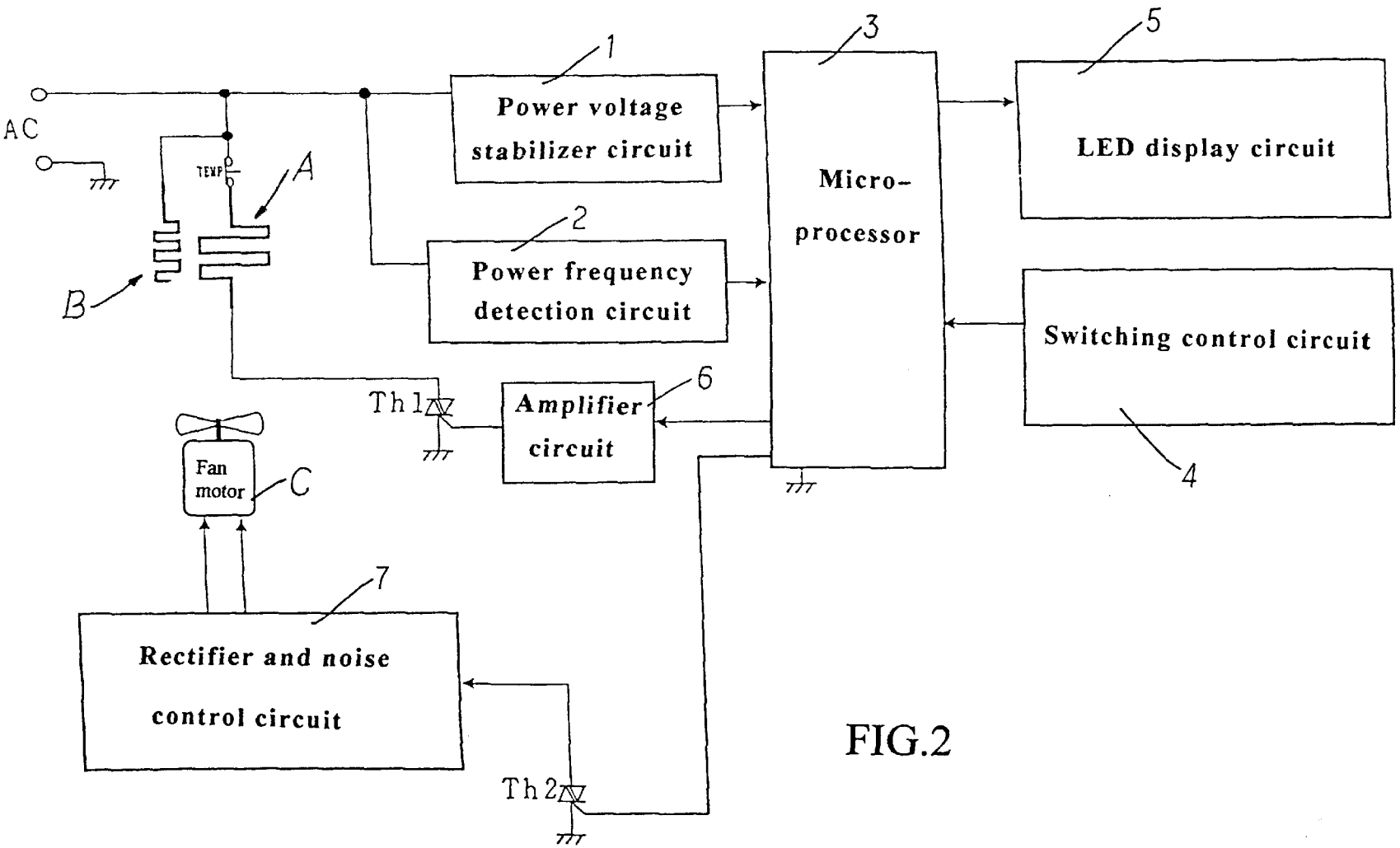
FIG. 2 is a circuit block diagram of the present invention.
Figure 3:
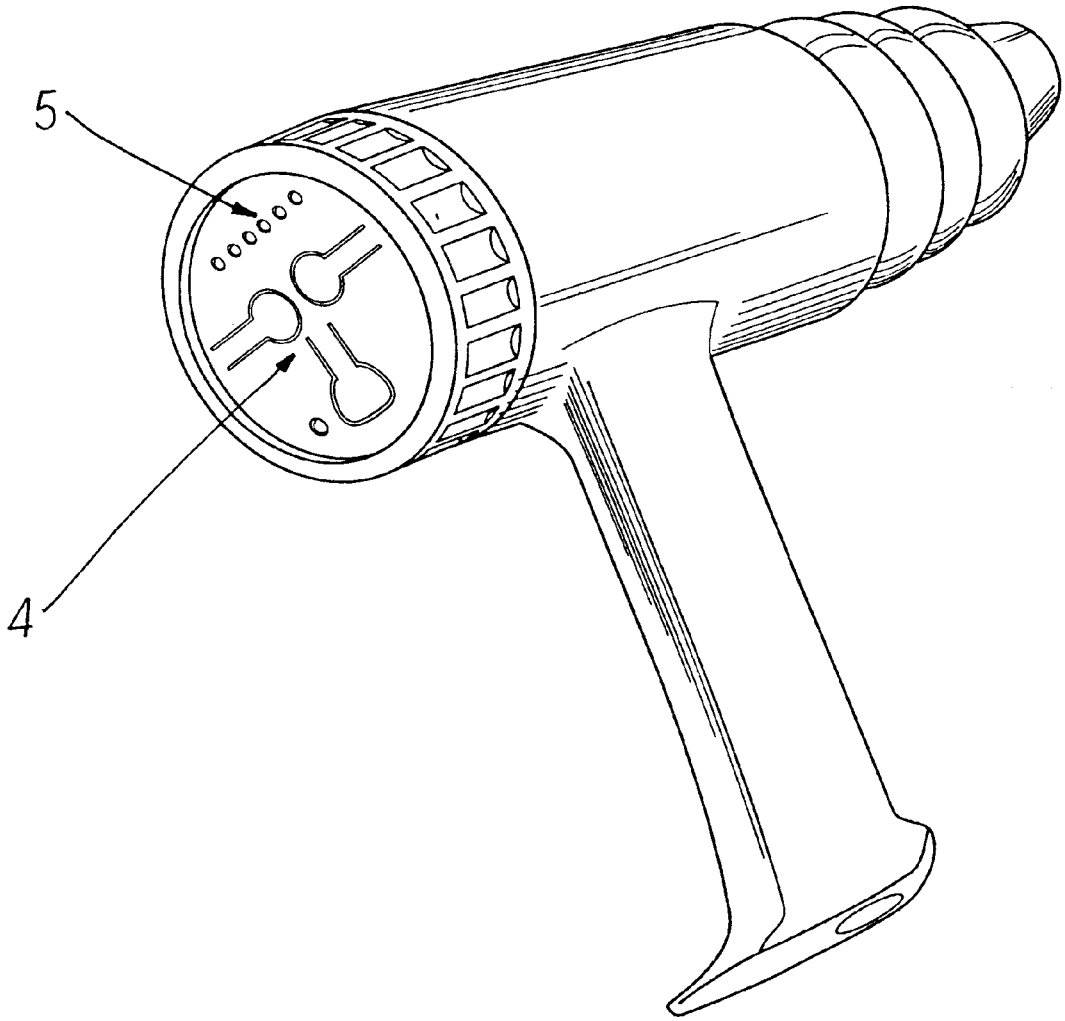
FIG. 3 illustrates a hot air-blower constructed according to the present invention.

Referring to FIGS. 2 and 3, a hot air-blower off-state residual heat preventive control circuit in accordance with the present invention is generally comprised of a power voltage stabilizer circuit 1, a power frequency detection circuit 2, a microprocessor 3, a switching control circuit 4, a LED display circuit 5, an amplifier circuit 6, and a rectifier and noise control circuit 7.

The hot air-blower comprises a main thermal resistor A, an auxiliary thermal resistor B, and a fan motor C controlled to blow air toward the main thermal resistor A and the auxiliary thermal resistor B. The switching control circuit 4 controls the on/off state and output power of the main thermal resistor A and the auxiliary thermal resistor B. The power voltage stabilizer circuit 1 rectifies input AC power supply into the rated working voltage for the microprocessor 3. The power frequency detection circuit 2 detects the frequency of input AC power supply, and sends detected power frequency data to the microprocessor 3. The rectifier and noise control circuit 7 receives power supply and signal outputted from the microprocessor 3, and processes received power supply and signal for controlling the operation of the fan motor C. The microprocessor 3 receives the necessary working voltage from the power voltage stabilizer circuit 1 and input AC power frequency data from the power frequency detection circuit 2 for further switching control. The microprocessor 3 has an input end connected to the switching control circuit 4 to receive hot air-blower on/off and high/low control instructions from the operator through the switching control circuit 4, a first output end connected to the amplifier circuit 6, which is in turn connected to the main thermal resistor A through a first bi-directional switch Th1, a second output end connected to the rectifier and noise control circuit 7 through a second bi-directional switch Th2, and a third output end connected to the LED display circuit 5. Through the amplifier circuit 6 and the first bi-directional switch Th1, the microprocessor 3 controls the output power of the main thermal resistor A. Through the second bi-directional switch Th2 and the rectifier and noise control circuit 7, the microprocessor 3 controls the output power of the auxiliary thermal resistor B and the operation of the fan motor C. Upon receipt of hot air-blower off instruction from the operator through the switching control circuit 4, the microprocessor 3 sends a signal to the first bi-directional switch Th1, causing it to turn off the main thermal resistor A, and at the same time continuously drives the auxiliary thermal resistor B and the fan motor C, causing the fan motor C to continuously blow air toward the main thermal resistor A and the auxiliary thermal resistor B. When the temperature of the hot air-blower drops below the safety range a certain length of time after off state of the main thermal resistor A, the microprocessor 3 sends a signal to the second bi-directional switch Th2, causing it to cut off power supply from the auxiliary thermal resistor B and the fan motor C.

The aforesaid LED display circuit 5 is connected to the microprocessor 3, and controlled by the microprocessor 3 to indicate different operation modes subject to the instructions given by the operator through the switching control circuit 4.

What the invention claimed is:

1. A hot air-blower off-state residual heat preventive control circuit installed in a hot air-blower of the type comprising a main thermal resistor, an auxiliary thermal resistor, a switching control circuit for operation by the user to turn on/off said main thermal resistor and said auxiliary thermal resistor, and a fan motor controlled to blow air toward said main thermal resistor and said auxiliary thermal resistor, the hot air-blower off-state residual heat preventive control circuit comprising:

a power voltage stabilizer circuit connected to AC power supply to convert AC power supply into a rated working voltage for a microprocessor;

a power frequency detection circuit, which detects the frequency of AC power supply provided to said power voltage stabilizer circuit;

a microprocessor, which receives the rated working voltage from said power voltage stabilizer circuit and the power frequency data from said power frequency detection circuit, and is controlled by said switching control circuit to turn on/off said main thermal resistor, said auxiliary thermal resistor, and said fan motor subject to;

a first bi-directional switch connected between said main thermal resistor and said microprocessor and controlled by said microprocessor to turn on/off said main thermal resistor:

a rectifier and noise control circuit and a second bi-directional switch connected in series between said microprocessor and said fan motor and controlled by said microprocessor to turn on/off said fan motor;

wherein when the user operates said switching control circuit to turn on the hot air-blower, said microprocessor drives said first bi-directional switch and said second bi-directional switch to turn on said main thermal resistor, said auxiliary thermal resistor and said fan motor; when the user operates said switching control circuit to turn off the hot air-blower, said microprocessor is driven by said switching control circuit to send a first signal to said first bi-directional switch, causing said first bi-directional switch to turn off said main thermal resistor, and to keep said fan motor and said auxiliary thermal resistor operating for a predetermined length of time, and then to send a second signal to said second bi-directional switch a predetermined length of time after the provision of said first signal to said first bi-directional switch, causing said second bi-directional switch to cut off power supply to said auxiliary thermal resistor and said fan motor.

2. The hot air-blower off-state residual heat preventive control circuit of claim 1 further comprising a LED display circuit connected to said microprocessor, and controlled by said microprocessor to indicate the operation status of the hot air-blower.

3. The hot air-blower off-state residual heat preventive control circuit of claim 1 further comprising an amplifier circuit connected in series between said first bi-directional switch and said microprocessor.

* * * * *